United States Patent [19]

Kronstein

[11] 4,316,752

[45] Feb. 23, 1982

[54] OXALIC ACID TREATMENT OF CARBON STEEL, GALVANIZED STEEL AND ALUMINUM SURFACES

[75] Inventor: Max Kronstein, Bronx, N.Y.

[73] Assignee: International Lead Zinc Research Organization, Inc., New York, N.Y.

[21] Appl. No.: 197,577

[22] Filed: Oct. 16, 1980

[51] Int. Cl.[3] ..... C23C 7/20; C23C 7/22

[52] U.S. Cl. ..... 148/6.16; 148/6.14 A; 148/6.15 R

[58] Field of Search ..... 148/6.14 A, 6.15 R, 148/6.16

[56] References Cited

U.S. PATENT DOCUMENTS

| | | | |
|---|---|---|---|
| 1,839,488 | 1/1932 | Mason | 134/41 |
| 2,798,015 | 7/1957 | Lesser | 148/6.16 |
| 3,355,330 | 11/1967 | Rothkegel et al. | 148/6.15 Z |
| 3,547,711 | 12/1970 | Ashdown | 148/6.14 A |

FOREIGN PATENT DOCUMENTS

| | | | |
|---|---|---|---|
| 2328726 | 1/1975 | Fed. Rep. of Germany | 148/6.14 A |

OTHER PUBLICATIONS

Streicher, *Metal Finishing,* Aug. 1948, pp. 61, 68.

*Primary Examiner*—Ralph S. Kendall
*Attorney, Agent, or Firm*—Brumbaugh, Graves, Donohue & Raymond

[57] ABSTRACT

The surface of a metal, namely, carbon steel (automotive steel), galvanized steel and/or aluminum, can be modified by treating the metal surface with a dilute aqueous oxalic acid solution. The resultant oxalic acid treated metal surface can be further treated with a phosphatizing bath. Such dual treatment improves the corrosion resistance of the metal surface and is particularly useful in the treatment of lighter weight automobile bodies having joints of carbon steel, galvanized steel and/or aluminum.

10 Claims, No Drawings

OXALIC ACID TREATMENT OF CARBON STEEL, GALVANIZED STEEL AND ALUMINUM SURFACES

The present invention relates to a process for modifying the surface of carbon steel (automotive steel), galvanized steel and/or aluminum used in the production of lighter weight automobile bodies, including joints, in order to provide corrosion resistance.

The prior art has required the surface treatment of aluminum to be conducted by anodizing the aluminum using an electric current or by similar processes. These processes are not readily applicable in the production of automobile bodies. The prior art was further confronted by the fact that the application of organic coating systems required different procedures for different metals and was not applicable to joints between them.

The present invention provides a process which overcomes these disadvantages.

The object of this process is to achieve a simultaneous surface treatment and modification of metal surfaces of lighter weight automobile bodies, including joints, based on carbon steel (automotive steel), galvanized steel and aluminum or of each of these metals separately in order to make it possible to increase simultaneously their corrosion resistance.

I have found that galvanized (i.e., zinc coated) steel, when immersed into a 15% by weight aqueous solution of oxalic acid at 65° C.–70° C., shows a gas development for only a very few seconds. Then a passivation layer is formed on the galvanized steel surface which prevents any further attack by the oxalic acid and therefore prevents a progressive weight loss of the metal (zinc coating) into the aqueous oxalic acid solution. Moreover, I have found that the so-treated surface is a suitable base for the subsequent application of a phosphatizing bath, such as those disclosed in my U.S. application Ser. No. 24,966, filed Mar. 29, 1979 (now U.S. Pat. No. 4,233,088).

On the other hand, it had been the belief of the prior art that aluminum surfaces require an electrical current treatment in order to be influenced by oxalic acid solutions before achieving a surface modification. Therefore, a number of special processes had been required, such as the so-called anodizing and similar processes.

The present invention has established and developed the fact that oxalic acid ions in a very dilute aqueous solution have a coating effect on aluminum and that this effect is the greatest between concentrations of from about 2% to about 5% by weight oxalic acid. The actual surface modification of the aluminum takes place at from about 65° C. to about 70° C. within approximately 10 minutes. Hereby a protective reaction layer is being formed which can be measured—similar to measuring the extent of phosphatizing coatings on steel—by determining the coating (stripping) weight of the treated aluminum. Such effected surface treatment of the aluminum then presents a suitable base for the subsequent application of a phosphatizing bath, including those mentioned above.

Also joints between galvanized steel and aluminum show that such phosphatizing treatment produces reaction coatings on the oxalic acid-treated aluminum as well as on the oxalic acid-treated galvanized steel. On the other hand, when joints are used between galvanized steel and aluminum which has not been treated with oxalic acid, the subsequent phosphatizing treatment only reacts on the galvanized steel, but not on the aluminum.

It has further been established that carbon steel (automotive steel) also is effectively surface modified by treatment with dilute aqueous oxalic acid and that such treatment then permits a very effective subsequent application of a phosphatizing bath which produces a phosphatized coating even more adherent than the one obtained without using the process of the present invention. The present invention is, therefore, also applicable to joints between carbon steel (automotive steel) and aluminum.

The process of the present invention will be further illustrated by the data set forth below.

EXAMPLE 1

It was desirable to establish the extent or amount of dissolution of the zinc coating on galvanized steel after immersion of the galvanized steel in dilute aqueous oxalic acid. Q panel, 0.030 inch, hot dipped, galvanized steel, unpassivated samples were stripped of their zinc in a solution of 600 ml. hydrochloric acid and 300 ml. formaldehyde (FORMALIN) at room temperature (Immersed until it stops reacting; about 30 seconds). The weight loss represents the amount of the removed zinc. The fact that the weight loss is greater after immersion of the galvanized steel into 2% and 4% aqueous oxalic acid solutions is the expression of the passivation layer formed on the zinc, which is taken off again by the stripping solution, jointly with the zinc. The stripped area in these tests was 36 sq. inches and the found weight loss was calculated for 1 sq. ft.

TEST I—Stripped the galvanized steel panel without oxalic acid treatment.

TEST II—Stripped the galvanized steel panel after 10 min. treatment in 2% oxalic acid (65° C.).

TEST III—Stripped the galvanized steel panel after 10 min. treatment in 4% oxalic acid (65° C.).

TEST IV—Stripped the galvanized steel panel after 10 min. treatment in 6% oxalic acid (65° C.).

TABLE 1

| Test | Untreated (g.) | After Oxalic Acid Treatment (g.) | After Stripping (g.) | Decrease or Weight Loss (g.) | Calculated Coating Weight (Zinc and Passivation Layer) (g/sq.ft.) | Calculated Coating Weight (Passivation Layer Alone) (mg/sq.ft. |
|---|---|---|---|---|---|---|
| I | 75.2618 | — | 72.3660 | 2.8958 | 11.583 | 0 |
| II | 75.1712 | 75.8952 | 72.9476 | 2.9476 | 11.790 | 207 |
| III | 74.3850 | 74.3910 | 71.4318 | 2.9592 | 11.837 | 254 |
| IV | 73.3636 | 73.3728 | 70.4764 | 2.8964 | 11.586 | 3 |

Immersion of aluminum panels (Q Panel A-36) also shows the best coatings in aqueous oxalic acid solutions of 2–5% concentration (Best around 3%). Therefore, for the test on a joint between aluminum and galvanized steel a 3% aqueous oxalic acid solution was used immersing half the joint for 10 minutes at 65° C. followed by immersing the whole joint for 5 minutes in a phosphatizing bath.

The phosphatizing treatment of this joint between galvanized steel and aluminum produced reaction coatings on the aluminum and on the galvanized steel of that half of the joint previously treated with the oxalic acid. However, on the other half of this joint which was not treated with oxalic acid, the phosphatizing bath only reacted with the galvanized steel and not with the aluminum.

EXAMPLE 2

Having determined in the above Example 1 that joints between galvanized steel and aluminum which had been treated with 3% aqueous oxalic acid solution can be phosphatized together without a separating area, the same procedure of Example 1 was followed with joints between carbon steel (automotive steel) and aluminum. Carbon steel Q panels were used of the type R-36 and the aluminum Q panel was the same type A-36 as used in Example 1.

The phosphatizing treatment of this joint between carbon steel and aluminum produced reacting coatings on the aluminum and on the carbon steel of that half of the joint previously treated with the oxalic acid, although only the color of the phosphatized carbon steel was uniform. However, on the other half of this joint which was not treated with oxalic acid, the phosphatizing bath only reacted with the carbon steel and not with the aluminum.

When the oxalic acid treatment of this joint between carbon steel and aluminum was carried out at a somewhat higher temperature between 80° C. and 90° C. and the joint then phosphatized, the color of the phosphatized carbon steel and the color of the phosphatized aluminum became more uniform, which may be desirable for automotive joints with subsequent paint application.

EXAMPLE 3

In Example 2 above, it was determined that phosphatized carbon steel was especially uniform in its phosphatization coating when that coating was applied over carbon steel which had been immersed in a 3% aqueous oxalic acid solution before phosphatizing and that the resulting color of the reaction coating was also influenced by the temperature of the oxalic acid treatment.

In a further study, it was found that the use of the same phosphatizing bath on carbon steel produced a coating (stripping) weight of between 140 and 150 mg/sq. ft. when the degreased panel had been briefly "pickled" with 40% phosphoric acid solution. It was also found that when the carbon steel had been immersed into 3% aqueous oxalic acid solution prior to further treatment with the phosphatizing bath, a higher coating (stripping) weight was obtained. Thus, the panel was immersed for 3 min. in 3% aqueous oxalic acid solution at 85° C. and then immersed for 4 min. in a phosphatizing bath followed by 5 min. in a chromic acid sealer and oven dried at about 150° C. for 5 min. This treated carbon steel panel now had a higher coating (stripping) weight of 186.4 mg/sq.ft.

EXAMPLE 4

Since the aluminum industry supplies a great number of varieties under the name of aluminum and aluminum alloys, an investigation was made as to what kind of aluminum is actually represented in the A-36 panels of the Q Panels Company which supplied the aluminum panels used in the above Examples 1 and 2. It was found that these A-36 aluminum panels represent actually the aluminum alloy 3003 H 14 with a thin chromium oxide conversion coating, referred to as ALODINE.

Therefore, there was then used their Grade A panel instead which is standard aluminum alloy 3003 H 14 without such chromium oxide conversion coating.

These two types of aluminum panels vary only in the fact that the Grade A alloy surfaces were still clear in appearance after the oxalic acid treatment, whereas the A-36 aluminum panels were cloudy after the oxalic acid treatment, perhaps because the oxalic acid influences the ALODINE treatment. Both types of aluminum panels, after treatment with 3% aqueous oxalic acid solution, were successfully phosphatized by treatment with a phosphatizing bath.

Thin pure aluminum foil obtained as ALUMINUM FOIL (6 inches×6 inches×0.001 inch) PURIFIED Al (Baker Chemical Company) was then used. In spite of being very glossy on one side, this surface also reacted on both sides with the 3% aqueous oxalic acid solution and afterwards reacted with the phosphatizing bath.

EXAMPLE 5

In the preceding Examples 1–4, the panels were treated with the aqueous oxalic acid solution, were water rinsed and then immersed in the phosphatizing bath. In this Example 5, both A-36 and Grade A aluminum panels were air dried for 2 hours between water rinsing and immersion in the phosphatizing bath. After the phosphatizing reaction, the surfaces were lighter in color than in Examples 1–4.

EXAMPLE 6

Even more effective phosphatizing treatments were obtained by the following three variant procedures.

(1) Grade A aluminum panels were first immersed for 30 seconds in a 20% phosphoric acid pickling solution. Then they were rinsed with water, treated with 3% aqueous oxalic acid solution and then treated with a phosphatizing bath. The phosphatization reaction coating was much darker and was even darker when this pickling step was extended to one minute.

(2) Very strong phosphatizing was also obtained on the Grade A aluminum panel when it was first immersed in a stripping solution of 600 ml. hydrochloric acid and 300 ml. formaldehyde (FORMALIN) and then, after rinsing with water, immersed in a 3% aqueous oxalic acid solution and then immersed in the phosphatizing bath.

(3) The Grade A aluminum panel was immersed for 2 minutes in the 3% aqueous oxalic acid solution, followed by a 15 second dip in the 20% phosphoric acid pickling solution and, after rinsing with water, the panel now had a slightly roughened surface. The panel was then again immersed for 5 minutes in the 3% aqueous oxalic acid solution, followed by treatment with the phosphatizing bath and by a chromic acid sealer.

EXAMPLE 7

Very uniform and well covered joints between a galvanized steel panel and a Grade A aluminum panel were obtained using a procedure similar to that of Example 6 (3), namely by applying 3% aqueous oxalic acid solution (85° C.) for 2 minutes, 20% phosphoric acid pickle (65° C.) for 1 minute, phosphatizing bath (75° C.) for 5 minutes and chromic acid sealer (54° C.–60° C.) for 5 minutes. A water rinse was used between the steps.

EXAMPLE 8

In other tests, a solution of crystal blue dye (as used in microscopy) was applied to an oxalic acid-treated zinc surface and also applied to a phosphatized oxalic acid-treated galvanized steel surface and the dye then washed off. Neither surface had been rendered porous by either of these treatments as shown by the fact that no blue pattern remained on the surfaces after washing.

In still other tests using atomic absorption spectroscopy and a calibration curve of absorption readings versus standard zinc solutions to measure the amount of dissolved zinc and using weight differential (gain) measurements between an untreated and an oxalic acid-treated panel, it was determined that the coating weight of the passivation layer (dissolved zinc plus panel weight gain) produced on a galvanized steel panel by treatment with 3% aqueous oxalic acid solution amounted to 292 mg/sq. ft.

EXAMPLE 9

In order to establish the effectiveness of the oxalic acid treatment followed by a phosphatizing treatment as a base for subsequent application of automotive organic coating systems the following Grade A aluminum panels were prepared:

(A) Two aluminum panels were immersed in a 3% aqueous oxalic acid solution at 85° C. for 3 minutes, rinsed with water and immersed for 4 minutes in a phosphatizing bath.

(B) Two aluminum panels were immersed in a 3% aqueous oxalic acid solution at 85° C. for 2 minutes, immersed in a phosphoric acid pickle at 65° C. for 30 seconds, given another 4 minute 3% oxalic acid treatment at 85° C. and a 4 minute phosphatizing bath treatment, and then treated with a chromic acid sealer for 5 minutes (water rinsed between each step).

(C) Two aluminum panels were immersed in a 3% aqueous oxalic acid solution at 85° C. for 2 minutes, immersed in a phosphoric acid pickle at 70° C. for 1 minute, treated with a phosphatizing bath at 80° C. for 4 minutes, and then treated with a chromic acid sealer at 65° C. for 5 minutes (water rinsed between each step).

All these panels received afterwards coats of an automotive industrial primer paint.

A test cross was cut through the coated panel surfaces (through to the aluminum) and the panels were exposed in a salt fog chamber for 240 hours. They were then rinsed with water to remove surface layers from the salt fog and they were allowed to dry at room temperature for 1 hour. Then a plastic tape was pressed solidly against the surface in the scribed area and was then suddenly pulled off in order to test the adherence of the coating after the exposure test. All these panels passed the test very well and no paint was lost.

For comparison the same test was made on galvanized steel panels (Q-panels), which were subjected to 1 minute of immersion in 3% oxalic acid (85° C.) and 3 minutes immersion in a phosphatizing bath and water rinsed. The same primer paint was applied and the panels scribed and salt fog exposed side-by-side with the aluminum panels. The same tape test was applied and again fully satisfactory adherence was observed.

The phosphatizing bath used in the foregoing Examples 1–9 was that of Example 2 of my U.S. application Ser. No. 24,966, filed Mar. 29, 1979 (now U.S. Pat. No. 4,233,088).

EXAMPLE 10

In Example 2 of my U.S. application Ser. No. 24,966, filed Mar. 29, 1979 (now U.S. Pat. No. 4,233,088), the phosphatizing solution contained besides sodium phosphate a small amount of phosphoric acid. This gives the phosphatizing solution in use on galvanized steel a certain degree of attack of the zinc layer of the galvanized steel. In agreement with the present invention it is now possible to decrease such attack by using in the described phosphatizing solution of Example 2 in my U.S. application Ser. No. 24,966 (now U.S. Pat. No. 4,233,088) instead of the added phosphoric acid a corresponding amount of oxalic acid. Hereby the attack by the acidic phosphatizing solution on galvanized steel is decreased and a satisfactory coating weight is obtained.

EXAMPLE 11

In an extension of the process described in Example 1 it is possible to increase the formation of the passivating coating layer on galvanized steel by using instead of the immersion in the aqueous oxalic acid solution an immersion in an oxalic acid passivating and coating-forming solution also containing a ligand-forming organic polymer (e.g., polyvinyl alcohol or methyl cellulose), for example 3 parts oxalic acid
6 parts polyvinyl alcohol (ELVANOL 90-50), DuPont)
91 parts water using about a 30-second immersion at around 80° C. The formed passivating layer shows an increased adherence to the metal, for instance, against the wiping or rubbing of the treated surface.

In summary, of the foregoing disclosure and data, the present invention provides a process for modifying the surface of a metal, namely, carbon steel (automotive steel), galvanized steel and/or aluminum, by treating, e.g., immersing or spraying, the metal surface with a dilute aqueous oxalic acid solution. Generally, the aqueous oxalic acid solution is used at a concentration of about 2% to about 5% by weight, usually about 3% by weight, and at a temperature in the range of from about 65° C. to about 90° C. for from about 3 minutes to about 10 minutes.

The resultant oxalic acid-treated metal surface can be further treated, e.g., by immersion or spraying, with a phosphatizing bath, such as those disclosed in my U.S. application Ser. No. 24,966, filed Mar. 29, 1979 (now U.S. Pat. No. 4,233,088), the entire disclosure of which application is hereby incorporated by reference herein.

The process of the invention encompasses numerous useful variations in the oxalic acid and phosphatizing bath treatments of the metal surface. Thus, the metal surface can be treated with a phosphoric acid pickling solution prior to treatment of the metal surface with the oxalic acid. Alternatively, the metal surface can be treated with a stripping solution comprising hydrochloric acid and formaldehyde prior to treatment of the metal surface with the oxalic acid. In another variant of the process of the invention, the metal surface can be treated successively with the oxalic acid, a phosphoric acid pickling solution and the phosphatizing bath. In addition, the metal surface can be treated successively with the oxalic acid, a phosphoric acid pickling solution, the oxalic acid and the phosphatizing bath. It is also possible to treat the phosphatized metal surface with a conventional chromic acid sealer or rinse and to rinse the metal surface with water between each treatment step.

What is claimed is:

1. A process for modifying the surface of a metal, characterized by treating the metal surface for from about 0.5 minute to about 10 minutes with a dilute aqueous oxalic acid solution having a temperature in the range of from about 65° C. to about 90° C. and consisting essentially of from about 2% to about 5% by weight oxalic acid and the balance water, the metal being at least one metal selected from the group consisting of carbon steel, galvanized steel and aluminum.

2. The process according to claim 1, characterized by the aqueous oxalic acid solution has a concentration of about 3% by weight.

3. The process according to claim 1, characterized by further treating the resultant oxalic acid-treated metal surface with a phosphatizing bath.

4. The process according to claim 3, characterized by treating the metal surface with a phosphoric acid pickling solution prior to treatment of the metal surface with the dilute aqueous oxalic acid solution.

5. The process according to claim 3, characterized by treating the metal surface with a stripping solution comprising hydrochloric acid and formaldehyde prior to treatment of the metal surface with the dilute aqueous oxalic acid solution.

6. The process according to claim 3, characterized by treating the metal surface successively with the dilute aqueous oxalic acid solution, a phosphoric acid pickling solution, and the phosphatizing bath.

7. The process according to claim 3, characterized by treating the metal surface successively with the dilute aqueous oxalic acid solution, a phosphoric acid pickling solution, the dilute aqueous oxalic acid solution and the phosphatizing bath.

8. The process according to claims 3, 4, 5, 6 or 7, characterized by treating the phosphatized metal surface with a chromic acid sealer.

9. The process according to claims 3, 4, 5, 6, or 7, characterized by rinsing the metal surface with water between each treatment step.

10. The process according to claim 1, characterized by the dilute aqueous oxalic acid solution also contains a ligand-forming organic polymer selected from the group consisting of polyvinyl alcohol and methyl cellulose.

* * * * *